United States Patent [19]

Columbus

[11] Patent Number: 4,971,763

[45] Date of Patent: Nov. 20, 1990

[54] LIQUID-CONTROLLING NOZZLE GEOMETRY FOR DISPENSERS OF LIQUIDS

[75] Inventor: Richard L. Columbus, Rochester, N.Y.

[73] Assignee: Eastman Kodak Company, Rochester, N.Y.

[21] Appl. No.: 310,151

[22] Filed: Feb. 14, 1989

[51] Int. Cl.[5] ..... B05B 11/00

[52] U.S. Cl. ..... 422/100; 73/864.01; 73/864; 422/99; 222/420

[58] Field of Search ..... 422/100, 63; 73/864.01, 73/864.02, 864.03, 864.11, 864.25; 222/420; 210/516

[56] References Cited

U.S. PATENT DOCUMENTS 3,449,081 6/1969 Hughes ..... 23/253
4,347,875 9/1982 Columbus ..... 141/18

*Primary Examiner*—Robert J. Warden
*Assistant Examiner*—Daniel Redding
*Attorney, Agent, or Firm*—Dana M. Schmidt

[57] ABSTRACT

Dispensing nozzles suffer from the problem of perfusion and can be relatively inaccurate in the amount of fluid dispensed each time. Described herein is a dispensing device which is provided with an improved nozzle construction. An exterior surface, having an aperture through which fluid is dispensed, has a second surface positioned adjacent to it. Further surfaces are arranged further up the nozzle. The arrangement of the surfaces is such that self-wiping of the device is maximized (if the device is also used for aspiration wherein the device is withdrawn from a supply of the liquid) and that perfusion is minimized during dispensing of the fluid contained therein. This is achieved by having the second surface angled to the first surface, defining an angle $\alpha$, relative to the first surface.

10 Claims, 4 Drawing Sheets

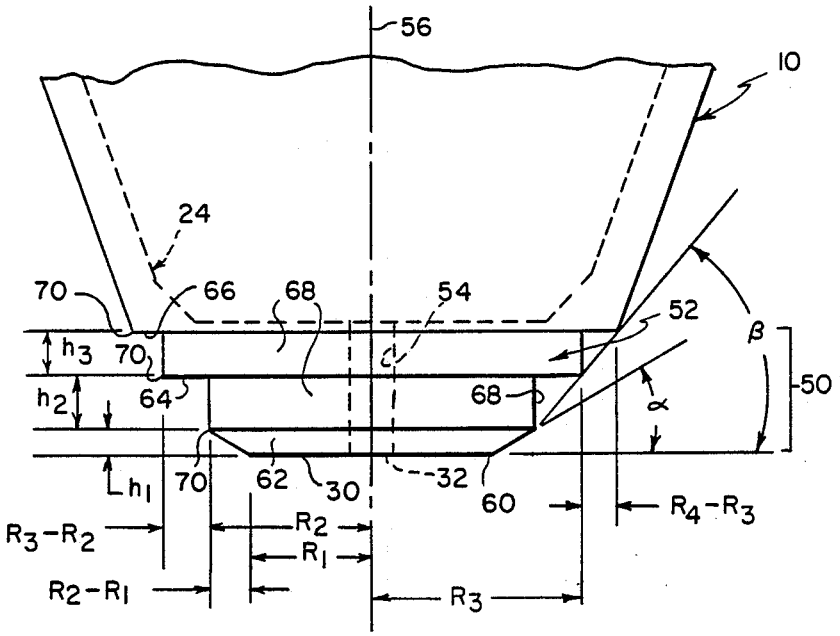
FIG. 4
FIG. 6
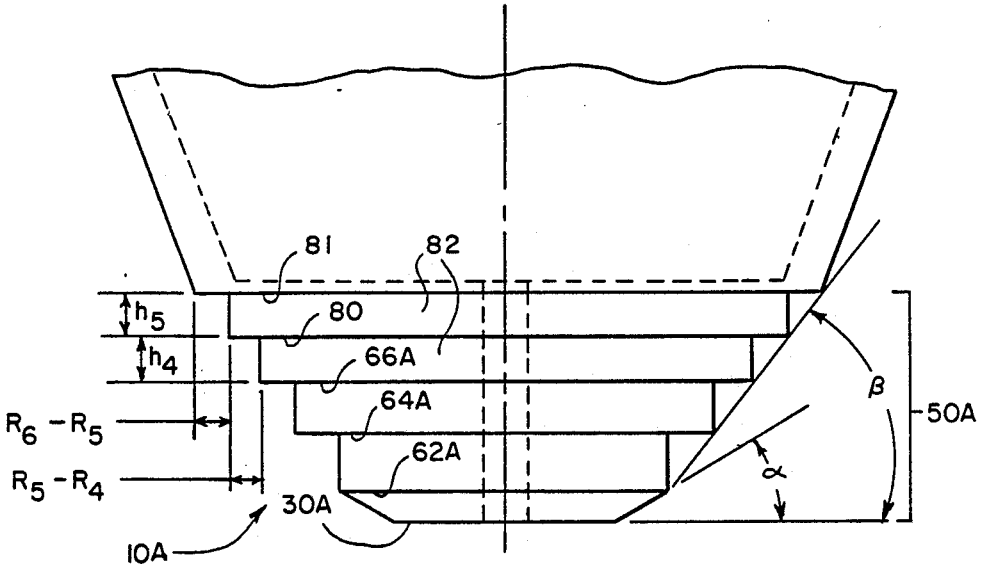

LIQUID-CONTROLLING NOZZLE GEOMETRY FOR DISPENSERS OF LIQUIDS

FIELD OF THE INVENTION

The invention is directed to containers used to aspirate and then dispense liquids for analysis.

BACKGROUND OF THE INVENTION

An entire industry has developed around the use of dried test elements for blood analyzers that contain the necessary reagents "all in the slide". Because of the high precision capable from such test elements, it is essential that patient samples be dispensed both with correspondingly high volumetric precision and consistent wetted area. More specifically, in the dispensing of about 10 μl volumes, the precision needs to be within 1% or less of the nominal value. This is not a trivial feat, since patient blood sera have viscosities that can vary from 1 to 20 cps, and a surface tension that can vary from 35 to 72 mN/m. What makes the task even more difficult is the fact that, for each assay to be run on the varying test elements, a different surface wettability is often presented to the dispensing station. Any chemistries encouraging non-wetting cause the dispensed liquid to try to perfuse up the side of the already-wetted nozzle. Perfusion, of course, causes gross variations in dispensing precision. Perfusion, to the extent it occurs, can be detected in peak pressures generated in the container during dispensing.

The above bad situation is made worse by the fact that the most economical method of getting the patient sample INTO the dispensing container, is by aspiration from a gross sample supply. To avoid having to wipe the exterior of the dispensing container used to dip and aspirate, the dispensing container must be designed keeping in mind that some residual patient sample will remain on the outside surface of the dispensing container, where it can easily interfere with dispensing if it has access to the dispensing orifice. That is, at best only a small amount of residuals from the exterior surface is needed to combine with the desired amount dispensed from the interior, before the imprecision in dispensing 10 μl exceeds 1%. At worst, large amounts of residuals can spontaneously fall off, contaminating equipment, test elements, or both.

The amount and location of those residuals becomes a factor of many conditions that are not always easily controlled, including the nature and concentration of sample proteins, speed of withdrawal of the dispensing container from the gross sample supply, the viscosity of this particular sample, the depth of submersion for aspiration, and the surface area of the pipette. Of these, only the last-named factor is determinative ab initio (by the container used in the analyzer), and this factor is not easily altered from specimen to specimen to meet changing needs.

The disposable dispensing container described in U.S. Pat. No. 4,347,875 goes a long way towards solving such dispensing problems. However, even it has trouble meeting universal needs, that is, those peculiar to some of the more esoteric test element chemistries, including total protein and $CO_2$, or to peculiar patient sample conditions, e.g., IgG multiple myeloma. Therefore, dispensing with the container of the U.S. Pat. No. 4,347,875 patent can produce an occasional unsatisfactory result, manifesting itself either as volume imprecision, or in the case of liquid perfusion a failure to dispense altogether. More specifically, a nominal 10 μl drop varies (in 10 dispensing events with Dade TM Moni-Trol TM ES level II general multipurpose control serum prepared with human blood and supplied ready to use with a bicarbonate diluent by American Scientific Products as a test liquid) from 9.259 μl mean value (±0.368) to as much as 10.583 μl mean value, ±0.166. Better results than this are desired, for example, results in which the mean value for 10 drops is never less than 9.93 μl nor more than 10.05, ±0.1.

SUMMARY OF THE INVENTION

I have provided a dispensing device that avoids the problems noted above, even when using liquid suspensions of greatly varying properties.

More specifically, there is provided a dispensing device for dispensing liquid a fraction at a time, the device comprising a passageway extending from a compartment capable of holding liquid and terminating in an aperture, and a nozzle comprising a liquid-confining wall wrapped around the passageway and terminating in a liquid-spreading first exterior surface disposed around the aperture, the wrapped-around wall having a second exterior surface extending from the first exterior surface up the side of the nozzle, configured to force liquid on the second surface to not interact with liquid dispensed through the aperture. The device is improved in that the second surface comprises: an inclined surface extending directly from the first surface at a first angle effective to force liquid on the exterior surfaces to detach after aspiration only when liquid has retreated from the inclined surface to the first surface, and a series of at least two generally annular stepped lands of increasing outer dimensions, spaced up the side of the nozzle to form a second, overall angle measured from the plane of the first surface, that is effective to drain off most exterior liquid during liquid drainage after aspiration. Preferably the lands each have a surface that is generally parallel to the first surface with a predetermined radial extension ($R_n$-$R_{n-1}$), the spacing of each of the stepped lands away from an adjacent land or surface closer to the aperture, and the predetermined radial extension, being effective to break up liquid remaining on the second exterior surface after detachment, into isolated droplets.

Thus, it is an advantageous feature of the invention that a dispensing container is provided that automatically minimizes the amount of residual liquid remaining on the exterior after aspiration.

It is a related advantageous feature of the invention that a dispensing container is provided that is generally free of perfusion errors during dispensing, regardless of variations that occur in the rheological properties of the liquid being dispensed.

Other advantageous features will become apparent from the following detailed description of the preferred embodiments, when read in light of the attached drawings.

BRIEF DESCRIPTION OF THE DRAWINGS

FIG. 4 is an enlarged fragmentary elevational view of the portion of FIG. 3 marked "IV";

FIGS. 6 and 7 are views similar to that of FIG. 4 but illustrating alternative embodiments.

DESCRIPTION OF THE PREFERRED EMBODIMENTS

The invention is hereinafter described in connection with the preferred embodiments, in which the dispensing device is a disposable tip for mounting onto apparatus such as a manual or automated pipette, to dispense onto a dried test element serum that can be first aspirated into and contained in the tip. In addition, the invention is applicable to a dispensing device that is a permanent part of an aspirator or dispenser, or of a disposable blood separation device, or of a container wherein only the nozzle portion is disposable. The invention is useful regardless of the liquid being dispensed or the test element that receives it. It is further useful whether or not the device itself stores liquid prior to dispensing, or merely is fluidly connected to a separate device that provides such storage.

The terms "up", "down", "bottom" and the like refer to orientations of parts during their preferred use, in an environment in which gravity is present. In addition, however, the invention is useful in an environment in which the "up" direction is arbitrary, such as a space station.

Figure 1A:
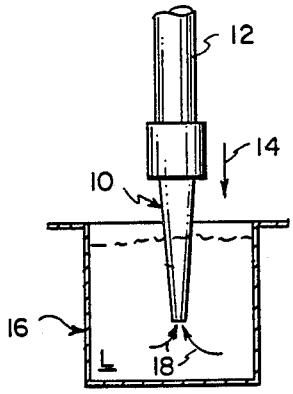
FIGS. 1*a*–1*c* is a fragmentary schematic illustration of the aspirating and dispensing steps that a dispensing device of the invention must incur.
Figure 1B:
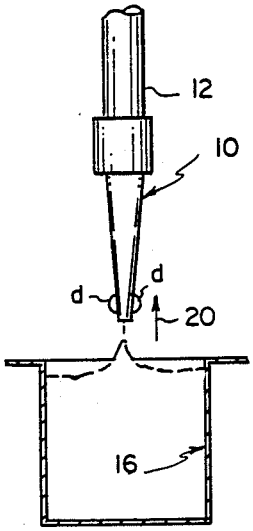
Figure 1C:
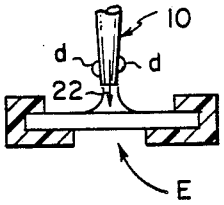

The problems to which the invention is directed are illustrated in FIG. 1. A dispensing container 10 is mounted on a pipette device 12, and is inserted, arrow 14, into a gross supply of liquid L in container 16, FIG. 1A. When a partial vacuum is generated in pipette device 12, liquid such as blood sera is drawn into dispensing container 10, arrows 18. Container 10 and device 12 are then withdrawn, arrow 20, FIG. 1B, and liquid breaks off, leaving drops "d" behind on the exterior surface of container 10. Container 10 is then placed adjacent to a test element E, FIG. 1C, and a partial pressure is generated to dispense a portion of the contained liquid, arrow 22. If the surface of that test element is relatively non-wetting, and/or if drops "d" touch the liquid being dispensed, perfusion of the liquid up the outside wall of container 10 is likely to occur. This in turn leads to significant variations in the amount of liquid received by element E, compared to the intended amount of, e.g., 10 μl.

Figure 2A:
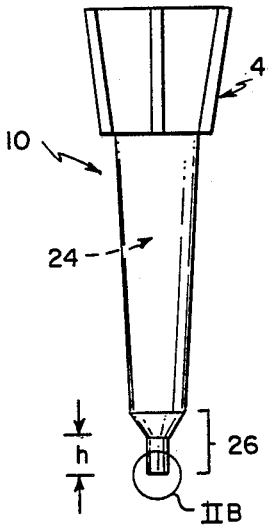
FIG. 2A PRIOR ART
FIGS. 2A and 2B are an elevational view and a fragmentary enlarged sectional view of a prior art dispensing device.
Figure 2B:
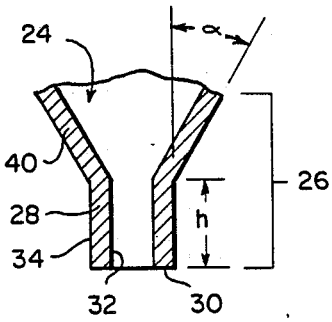
FIG. 2B PRIOR ART

The aforementioned solution to this problem described in U.S. Pat. No. 4,347,875, is illustrated for comparison in FIGS. 2A and 2B. In this dispensing device or container 10, a liquid storage compartment 24 is provided with a nozzle portion 26 comprising a wall member 28 having a bottom surface 30. Dispensing aperture 32 is formed in that surface. Nozzle portion 26 also includes an exterior surface 34 that has means at predetermined loci spaced (preferably distance "h") from surface 30 for attracting excess liquid on surface 34, away from surface 30. Most preferably, such attracting means is the portion 40 of surface 34 that is angled at angle $\alpha$ to form a conical surface. Distance "h" is preferably a value of from about 0.02 cm to about 0.5 cm.

Upper portion 44 is optionally ribbed to allow easier handling of the container.

Figure 3:
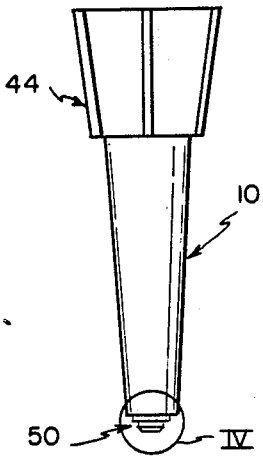
FIG. 3 is an elevational view of a dispensing device constructed in accordance with the invention.

In accord with the invention, container 10 is improved in that it is provided with a new nozzle configuration 50, FIGS. 3 and 4. As before, container 10 includes a liquid storage compartment 24, which can acquire by aspiration as much as 400 μl of liquid for dispensing. Nozzle portion 50 has been modified, however, to reflect certain liquid flow properties described hereinafter. As to its structure, nozzle 50 is formed from a wall 52 that is wrapped around a passageway 54 that fluidly connects orifice 32 with compartment 24, FIG. 4. Most preferably, container 10 and especially nozzle 50 has an axis of symmetry 56 that is centered in passageway 54 and aperture 32.

As before, nozzle 50 includes a bottom surface 30 extending a distance, preferably a radius $R_1$, from axis 56. Preferably surface 30 is an annulus. Useful values of $R_1$ are set forth hereinafter. However, unlike the design shown in FIG. 2, surface 30 is joined directly at edge 60, FIG. 4, with a surface 62 inclined at an angle $\alpha$ to surface 30, the sign of angle $\alpha$ being such as to cause surfaces 30 and 62 to form a convex surface. Surface 62 is generally annular and extends to subtend a distance, preferably a difference radius $R_2$-$R_1$, from axis 56. As used herein "generally annular" is satisfied if the shape approximates an annulus. In addition, nozzle 50 features a series of lands 64 and 66 stepped back along axis 56, up the side of the nozzle. Each of these lands is preferably generally annular in shape and generally parallel to surface 30 and has a dimension, preferably a radius $R_3$ and $R_4$, respectively, from axis 56, so that the surface area of each land is a function of the difference in the two bounding radii, $R_N$-$R_{N-1}$, where N is 3 for land 64, and N is 4 for land 66. Each land is stepped back, preferably straight back, so as to be spaced, along axis 56, a distance of $h_2$ and $h_3$, respectively, from the adjacent surface closer to surface 30. (Distance $h_1$ for surface 62 is, of course, predetermined by the value of angle $\alpha$ and radii $R_1$ and $R_2$.)

An important feature of lands 64 and 66 is that their outermost radii $R_3$ and $R_4$, respectively, give to the exterior surface of nozzle 50, an overall angle $\beta$, measured from the plane of surface 30, that is effective to give maximum drainage of liquid on the exterior of nozzle 50, as described hereinafter. Other important features are the recesses formed by the step in each land, and distances $h_2$ and $h_3$. That is, each step forms a gap in the overall cone shape suggested by angle $\beta$, with a step-back surface 68 providing distance $h_2$ and $h_3$, such gaps being effective to trap and break up sheaths of liquid left on the exterior of nozzle 50 during withdrawal of the container from the gross liquid supply.

Figure 8:
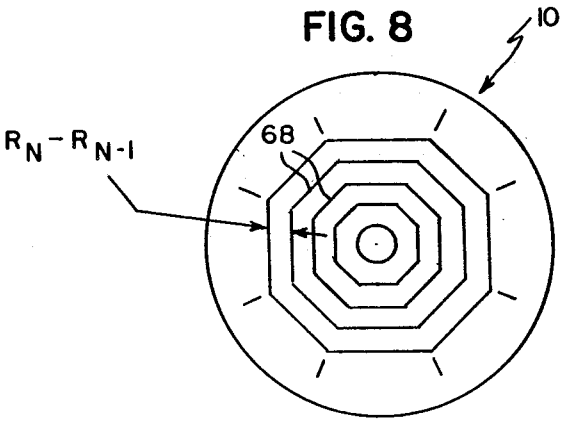
FIG. 8 is an end view of a device of the invention, illustrating yet another embodiment.

It will be recognized that the shape of lands 64 and 66 need only be roughly annular, in which case $R_N$-$R_{N-1}$ is not strictly speaking determined by subtracting radii. In cases where $R_N$ and $R_{N-1}$ are dimensions of a non-circular curve, FIG. 8, the value of $R_N$-$R_{N-1}$ is simply the width of that land as it extends around step-back surface 68. Although eight-sided rings are shown, FIG. 8, the number and even existence of "sides" is not critical.

The following Table gives a list of preferred ranges, and of an exemplary "most preferred" value, for each of the aforementioned dimensions.

| Items | Dimensional Values Range | Most Preferred |
|---|---|---|
| Angle $\alpha$ | 6°-30° | 12° |
| Angle $\beta$ | 40°-60° | 53° |
| radius $R_1$ | 0.057-0.076 cm | 0.063 cm |
| radius difference ($R_2 - R_1$) | 0.013-0.13 cm | 0.063 cm |
| radius difference ($R_3 - R_2$) | 0.013-0.13 cm | 0.076 cm |
| radius difference ($R_4 - R_3$) | 0.013-0.13 cm | 0.076 cm |
| height $h_2$* | 0.035-0.08 cm | 0.05 cm |
| height $h_3$* | 0.02-0.05 cm | 0.04 cm |

*The reason for these being different from each other is explained hereinafter.

Most preferably, each of the edges 70 created by the intersection of a surface such as land 64, 66, or surface 62, with the vertically-extending step-back surface 68, is relatively sharp, that is, has a radius of curvature not to exceed about 0.02 cm.

The significance of each of the topological features of nozzle 50 will now be described, with reference to FIGS. 5A-5D.

Figure 5C:
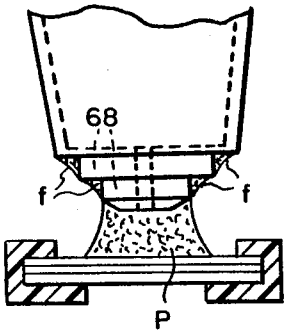
FIGS. 5A–5E are fragmentary elevational views, partly in section, illustrating the criticality of certain features of the invention.
Figure 5B:
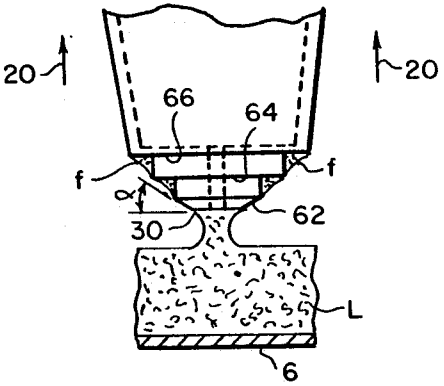
Figure 5A:
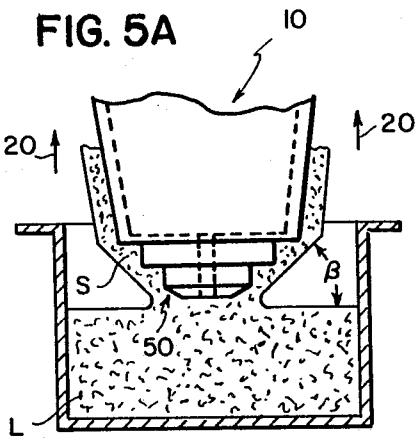

Angle $\beta$ is selected because of the manner in which liquid drains from nozzle 50 as container 10 is withdrawn, arrow 20, FIG. 5A. High-speed studies have shown that the first events in the withdrawal tend to leave a sheath of liquid "S", which forms an angle to the remaining liquid L that is in fact a value of about 53°, or angle $\beta$ if $\beta$ is 53°. Thus, the best value for $\beta$ is a value that mimicks this angle, although variances of $-13°$ to $\pm 7°$ will also work, though less efficiently.

Angle $\alpha$ is selected because of the next event in the withdrawal of nozzle 50 from liquid L, FIG. 5B. That is, at the moment nozzle 50 and its residual liquid are ready to break free of liquid L in container 16, the residual liquid on surface 30 of the nozzle forms with liquid L, a "wiping angle" that is about 6° to 30°, usually about 12°. Thus, the cleanest construction to encourage the liquid "L" to wipe cleanly off of surface 62, and the preferred construction, is one in which surface 62 is inclined at that same angle. Although other values are not as efficient, angle $\alpha$ can be varied as shown in the Table.

It will also be apparent from FIGS. 5B and 5C the function performed by the steps 64 and 66. The space left by these steps provides 3-dimensional fillets of volume that receive and redistribute fillet or droplet portions "f" of the residual sheath, thus breaking up the sheath, FIG. 5B. Such breakage is critical, because any sheath that remains as a complete volume, can have enough weight to slide down the nozzle and contact the dispensed portion "P", FIG. 5C, and unacceptably change the volume of that dispensed portion. Fillets "f" are disconnected from each other, and remain trapped between lands 64 and 66, and the step-back surface 68 producing the land, FIG. 5C. Thus, accurate dispensing can take place with essentially no unacceptable change in the intended volume.

Figure 5E:
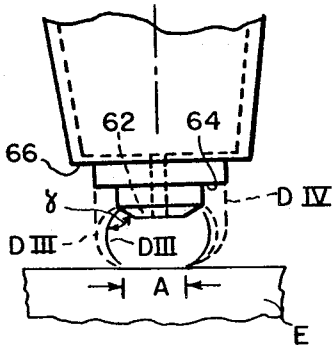
Figure 5D:
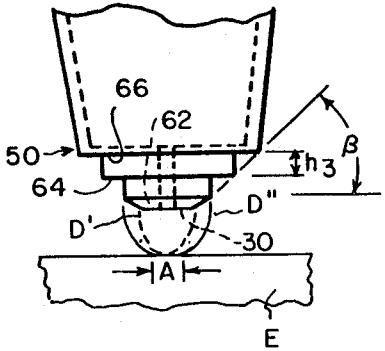

FIG. 5D illustrates the reason for $h_2$ and $h_3$ having different values. As shown in this Figure, the 10 $\mu$l drop D' to be dispensed hangs from surface 30 just prior to wetting the test element E. If this drop readily wets the surface of element E, then the liquid will also set surface 62 and move to position D'' on nozzle 50, while dispensing into the element. The area wetted on element E is area A. If however the surface is relatively non-wetting then additional liquid volume is added to the initial drop D'' to produce a drop D''' of 10 $\mu$l volume (since element E is slow to wet), FIG. 5E, that proceeds to bulge out first to the solid line position and then to the dotted line position. When angle $\gamma$ reaches and exceeds about 90°, the liquid jumps beyond surface 62 and onto land 64, as shown by the dashed line, $D^{IV}$. That is, the surface area of land 64, taken with the areas of surfaces 62 and 30, will support a 10 $\mu$l volume while maintaining angle $\gamma$ less than 90°. However, land 66 is a different story. Its separation distance $h_3$ is selected to be large enough so that the volume that can be supported from surfaces 62, 64 and 66 combined, exceeds the total volume to be dispensed. Thus, there is insufficient differential pressure created at radius $R_3$ to force drop $D^{IV}$ to spread off of land 64 onto land 66. The wetted area A of element E remains relatively constant, FIGS. 5D and 5E. $h_3$ is preferably no smaller than the 0.02 cm minimum stated in the Table above, for the reason that the step created at land 66 for a given angle of $\beta$ becomes to small to insure that sheath S, FIG. 5A, is effectively broken up into isolated 3-dimensional fillets of liquid extending around the steps' perimeter, FIGS. 5C.

Additional lands can be added further "up" the nozzle towards the storage compartment, FIG. 6. Parts similar to those previously described bear the same reference numeral to which the distinguishing suffix "A" has been appended.

Thus, referring to FIG. 6, container 10A has a nozzle 50A constructed substantially as before, with a bottom surface 30A, annular ring surface 62A, and steps 64A and 66A. In addition, however, two other steps 80 and 81 have been added each spaced directly back via a step-back wall 82 to give a separation distance $h_4$ and $h_5$. Most preferably, each step 80 and 81 has a radial extension $R_5$-$R_4$ or $R_6$-$R_5$. $R_5$-$R_4$ has the same range and preferred value as $R_4$-$R_3$, whereas $R_6$-$R_5$ is substantially less. Furthermore, $h_4$ and $h_5$ preferably have about the same range and preferred value as $h_3$. Angles $\alpha$ and $\beta$ are as before.

To establish the superior nature of this dispensing container, compared to the container of FIG. 2, 10 containers of FIG. 2 and of FIG. 6 were tested, each with 300 $\mu$l of Dade TM Moni-Trol TM ES level II control serum. They were each mounted on the same automated pipette which was programmed to dispense 10 $\mu$l drops. For each container, nine drops were dispensed, after the liquid was first aspirated in using the process of FIGS. 1A and 1B shown above. The volumes so dispensed were measured, along with the mean values and the standard deviations. The following are the results:

| Mean Values | Standard Deviation | Mean Values | Standard Deviation |
|---|---|---|---|
| 1st Drop | 9.766 | 0.699 | 11.064* | 0.184 |
| 2nd Drop | 9.259 | 0.368 | 9.993 | 0.147 |
| 3rd Drop | 9.912 | 1.136 | 10.009 | 0.085 |
| 4th Drop | 9.656 | 0.229 | 10.044 | 0.112 |
| 5th Drop | 9.919 | 0.113 | 9.987 | 0.063 |
| 6th Drop | 10.237 | 0.045 | 9.948 | 0.058 |
| 7th Drop | 10.583 | 0.166 | 9.938 | 0.092 |
| 8th Drop | 10.501 | 0.216 | 9.976 | 0.059 |
| 9th Drop | 10.268 | 0.146 | 9.976 | 0.117 |

*An artifact due to software optimized to work with the FIG. 2 device.

For the FIG. 2 device, this gives a three $\sigma$ (sigma) total (three standard deviations) of 0.48 within-drop variation, and 0.37 as a drop-to-drop variation. For the FIG. 6 device, if the first drop is ignored for the artifact that it is (due to software optimized to the FIG. 2 configuration only), then the $3\sigma$ (sigma) variations for within-drop is only 0.11 and for drop-to-drop is only 0.033.

Figure 7:
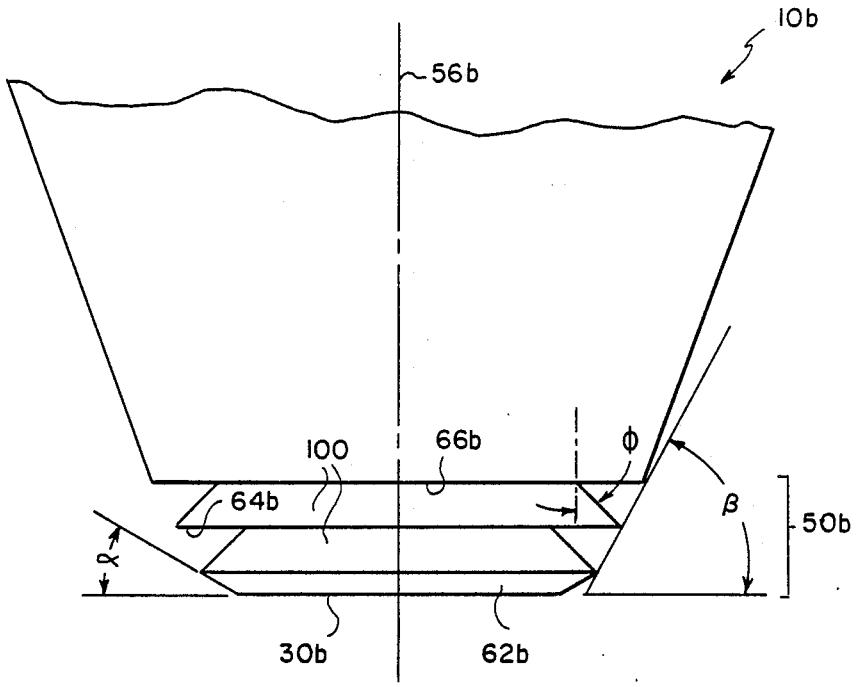

It is not essential that each land be formed by a step-back surface 68 that is always parallel to the container axis. Instead, such step-back surfaces can be inclined to the axis, FIG. 7, to form an acute angle $\phi$ between the lands and the step-back surface. Parts similar to those previously described have the same reference numeral, to which the distinguishing suffix "B" has been appended. Thus, container 10B has a nozzle 50B in which surfaces 30B and 62B are as before. However, lands 64B and 66B are spaced back by step-back walls 100 that are inclined by acute angle $\phi$ to axis 56B. The overall effect on angles $\alpha$ and $\beta$ is, however, nil. Angle $\phi$ can have values of from 75° to about 120°.

As in the case of the device of FIG. 2, the containers of this invention can be manufactured from any material, most preferably synthetic polymers.

The invention has been described in detail with particular reference to preferred embodiments thereof, but it will be understood that variations and modifications can be effected within the spirit and scope of the invention.

What is claimed is:

1. In a dispensing device for dispensing liquid a fraction at a time, the device comprising a compartment capable of holding liquid, a passageway extending from said compartment and terminating in an aperture, and a nozzle comprising a liquid-confining wall wrapped around said passageway and terminating in a liquid-spreading first exterior surface disposed around said aperture, said wrapped-around wall having a second exterior surface extending from said first exterior surface up the side of said nozzle, configured to force liquid on said second surface to not interact with liquid dispensed through said aperture;

the improvement wherein said second surface comprises:

an inclined generally annular surface extending directly from said first surface at a first angle effective to force liquid on said exterior surfaces to detach from a source of liquid only when liquid has retreated from said inclined surface to said first surface, said first angle being less than 90°, and a series of at least two generally annular stepped lands of increasing outer dimensions, spaced up the side of said nozzle to form a second, overall angle measured from the plane of said first surface, that is effective to drain off most exterior liquid during liquid drainage off the device.

2. A device as defined in claim 1 or 3, wherein said lands each have a surface that is generally parallel to said first surface with a predetermined radial extension, the spacing of each of said stepped lands away from an adjacent land or surface closer to said aperture, and said predetermined radial extension, being effective to break up liquid remaining on said second exterior surface after detachment, into isolated fillets of liquid.

3. In a dispensing device for dispensing liquid a fraction at a time, the device comprising a compartment capable of holding liquid, a passageway extending from said compartment and terminating in an aperture, and a nozzle comprising a liquid-confining wall wrapped around said passageway and terminating in a liquid-spreading first exterior surface disposed around said aperture, said wrapped-around wall having a second exterior surface extending from said first exterior surface up the side of said nozzle, configured to force liquid on said second surface to not interact with liquid dispensed through said aperture;

the improvement wherein said second surface comprises;

an inclined annular surface extending directly from said first surface at a first angle effective to force liquid on said exterior surfaces to detach from a source of liquid only when liquid has retreated from said inclined surface to said first surface, said first angle having a value of between about 6° and about 30°, and a series of at least two generally annular stepped lands of increasing outer dimensions, spaced up the side of said nozzle to form a second, overall angle measured from the plane of said first surface, that is effective to drain off most exterior liquid during liquid drainage off the device.

4. A device as defined in claim 3, wherein said second angle has a value of between about 40° and about 60°.

5. A device as defined in claim 2, wherein said predetermined radial extension of said annular land surfaces is an amount of between about 0.01 cm and about 0.13 cm.

6. A device as defined in claim 5, wherein said second angle has a value of between about 40° and about 60°.

7. A device as defined in claim 1 or 3, wherein said spacing of said stepped lands along said axis is in an amount of between about 0.035 cm and about 0.08 cm from said first annular surface for the one of said lands closest to said first exterior surface, and in an amount of between about 0.02 cm and about 0.05 cm for each of the other of said stepped lands measured from the adjacent land closer to said first exterior surface.

8. A device as defined in claim 7, wherein said predetermined radial extension of said annular land surfaces is an amount of between about 0.013 cm and about 0.13 cm.

9. A device as defined in claim 7, wherein said second angle has a value of between about 40° and about 60°.

10. In a container device useful for aspirating liquid, storing the aspirated liquid, and then dispensing the stored liquid a fraction at a time, the device comprising a compartment having a storage capacity for the total liquid to be aspirated, a nozzle in fluid communication with said compartment and comprising a liquid-confining wall wrapped around an axis of symmetry and terminating in a liquid-spreading first exterior surface, said first surface having an aperture therein fluidly communicating with said compartment, said wall having a second exterior surface extending from said first exterior surface up the side of said nozzle, configured to force liquid on said second surface to not interact with liquid dispensed through said orifice;

the improvement wherein said second surface comprises:

a first annular surface extending directly from said first surface at an angle of about 12°, measured from said first exterior surface extended, and a series of four stepped lands of increasing outer dimensions, spaced up the side of said nozzle to form an overall angle of about 53°, measured from said first exterior surface extended, each of said lands having an annular surface that is generally parallel to said first surface with a radial extension dimension that is between about 0.013 cm and about 0.13 cm, the one of said lands closest to said first exterior surface being spaced from said first annular surface along said axis a distance of about 0.05 cm, and the remaining of said stepped lands being spaced along said axis from the adjacent land closer to said first exterior surface a distance of about 0.04 cm.

* * * * *

UNITED STATES PATENT AND TRADEMARK OFFICE

CERTIFICATE OF CORRECTION

PATENT NO. : 4,971,763

DATED : November 20, 1990

INVENTOR(S) : Richard L. Columbus

It is certified that error appears in the above-identified patent and that said Letters Patent is hereby corrected as shown below:

Column 5, line 30 should read: +7° will also work, though less efficiently.

Column 6, line 17 should read: step created at land 66 for a given angle of $\beta$ becomes too Column 6, line 20 should read: extending around the steps' perimeter, FIG. 5C.

Column 6, lines 52-53, the table headings and subheadings should read as follows:

| Drop # | Figure 2 Device | | Figure 6 Device | |
|---|---|---|---|---|
| | Mean Values | Standard Deviation | Mean Values | Standard Deviation |

Column 8, line 37 should read: 8. A device as defined in claim 3, wherein said prede-

Signed and Sealed this

Thirtieth Day of June, 1992

*Attest:*

DOUGLAS B. COMER

*Attesting Officer*

*Acting Commissioner of Patents and Trademarks*